US011108189B2

(12) United States Patent
Moriyama

(10) Patent No.: US 11,108,189 B2
(45) Date of Patent: Aug. 31, 2021

(54) CONNECTOR WITH COVER

(71) Applicant: Sumitomo Wiring Systems, Ltd., Mie (JP)

(72) Inventor: Noboru Moriyama, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/807,235

(22) Filed: Mar. 3, 2020

(65) Prior Publication Data

US 2020/0287319 A1 Sep. 10, 2020

(30) Foreign Application Priority Data

Mar. 5, 2019 (JP) ..... JP2019-039498

(51) Int. Cl.

| | |
|---|---|
| ***H01R 13/52*** | (2006.01) |
| ***H01R 13/533*** | (2006.01) |
| ***H01R 13/516*** | (2006.01) |
| ***H01R 13/42*** | (2006.01) |
| ***H01R 13/639*** | (2006.01) |

(52) U.S. Cl.

CPC ..... *H01R 13/5205* (2013.01); *H01R 13/42* (2013.01); *H01R 13/516* (2013.01); *H01R 13/533* (2013.01); *H01R 13/639* (2013.01); *H01R 2201/26* (2013.01)

(58) Field of Classification Search

CPC .. H01R 13/5205; H01R 13/42; H01R 13/516; H01R 13/533; H01R 13/639; H01R 2201/26

USPC ..... 439/587

See application file for complete search history.

(56) References Cited

U.S. PATENT DOCUMENTS

| | | | | |
|---|---|---|---|---|
| 2004/0132352 | A1* | 7/2004 | Ward | H01R 13/4365 439/752 |
| 2013/0102163 | A1* | 4/2013 | Basavarajappa | E05B 81/66 439/34 |
| 2013/0333944 | A1* | 12/2013 | Sakakura | H01R 13/5804 174/74 R |
| 2014/0206213 | A1 | 7/2014 | Kato et al. | |
| 2016/0294110 | A1* | 10/2016 | Motohashi | H01R 13/512 |
| 2017/0256893 | A1* | 9/2017 | Kato | H01R 13/6596 |
| 2018/0006401 | A1* | 1/2018 | Ishibashi | H01R 13/621 |

(Continued)

FOREIGN PATENT DOCUMENTS

JP 2013-73743 4/2013

*Primary Examiner* — Edwin A. Leon

(74) *Attorney, Agent, or Firm* — Gerald E. Hespos; Michael J. Porco; Matthew T. Hespos

(57) ABSTRACT

A connector remains attached to a vehicle body and prevents water intrusion during high-pressure washing. The connector with cover is mounted on a vehicle body. The connector includes a wire, a connector housing including a housing body having a wire holding portion for holding an end of the wire, and a cassette continuous with the housing body and having an insertion slot in one surface. A sealing member seals a clearance between the wire holding portion and the wire by being mounted on the wire, and a cover covers the wire holding portion and the wire by being assembled with the connector housing. The cover includes a bracket having an insertion piece to be inserted into the cassette through the insertion slot, the bracket is assembled with the cassette, and a vehicle body mounting portion is connected to the bracket and mounted on the vehicle body.

4 Claims, 12 Drawing Sheets

(56) References Cited

U.S. PATENT DOCUMENTS

| | | | | |
|---|---|---|---|---|
| 2020/0076139 | A1* | 3/2020 | Lehnert | H01R 13/5213 |
| 2020/0269778 | A1* | 8/2020 | Komori | H02G 15/013 |

* cited by examiner

CONNECTOR WITH COVER

BACKGROUND

Field of the Invention

This specification relates to a connector with cover.

Related Art

A known waterproof structure includes a rubber plug for sealing a clearance between a wire and a connector housing. For example, Japanese Unexamined Patent Publication No. 2013-73743 discloses a connector of this type with a cassette-type inserting portion arranged on a side surface of a connector housing. The tip of a bracket provided on a vehicle body is inserted into the cassette-type inserting portion to fix the connector to the vehicle body.

Water pressure higher than usual acts when a vehicle is washed under high pressure, and there is a request for a connector housing that avoids water intrusion into in this situation without a large design change of the connector.

SUMMARY

A connector disclosed by this specification is to be mounted on a body of a vehicle. The connector has a wire and a connector housing with a housing body having a wire holding portion for holding an end of the wire. A cassette is continuous with the housing body and has an insertion slot in one surface. A sealing member is mounted on the wire and seals a clearance between the wire holding portion and the wire. A cover covers the wire holding portion and the wire. The cover includes a bracket having an insertion piece to be inserted into the cassette through the insertion slot for assembling bracket with the cassette. A vehicle body mounting portion is connected to the bracket and is mounted on the vehicle body.

The connector disclosed by this specification reliably avoids water intrusion into the housing without a large design change even when a water pressure higher than usual acts, such as when the vehicle is washed under high pressure.

According to the above configuration, the cover covers the wire holding portion and the wire drawn out from the wire holding portion. Specifically, the cover covers a part where the clearance between the wire holding portion and the wire is sealed by the sealing member. Thus, the cover avoids a direct hit of water on the sealed part is avoided and prevents water intrusion into the connector housing from the sealed part even when a water pressure higher than usual acts, such as when the vehicle is washed under high pressure.

The cover has the bracket to be assembled with the cassette and the vehicle body mounting portion to be mounted on the vehicle body. This configuration enables the cassette that conventionally is provided to mount the connector housing on the vehicle body to be utilized for mounting on the cover. Thus, the cover can be mounted on the connector housing and waterproof performance can be improved without a large design change.

The vehicle body mounting portion may be continuous with the bracket. Thus, an assembled part of the connector housing and the cover and an assembled part of the cover and a vehicle body panel can support each other. Accordingly, mounting strength to resist a high water pressure is stronger than if the vehicle body mounting portion and the bracket are distant from one another.

The cassette may include an outer wall arranged along the insertion piece, and the bracket may include an auxiliary piece arranged to sandwich the outer wall between the insertion piece and the auxiliary piece. According to this configuration, the cover is less likely to be detached from the connector housing and mounting strength is improved even when a water pressure higher than usual acts on the connector.

The vehicle body mounting portion may extend toward a side opposite to the connector housing with respect to the bracket. According to this configuration, the connector housing, the assembly of the connector housing and the cover and the assembly of the cover and the vehicle body panel are arranged in a row. Thus, the assembly of the connector housing and the cover and the assembly of the cover and the vehicle body panel can support each other to increase a hold-on force and mounting strength is ensured when a water pressure higher than usual acts.

Specific examples of the technique disclosed by this specification are described below with reference to the drawings. Note that the invention is not limited to these examples. The invention is intended to be defined by claims and includes all changes within the scope of claims and within the meaning and scope of equivalents.

DETAILED DESCRIPTION

Figure 1:
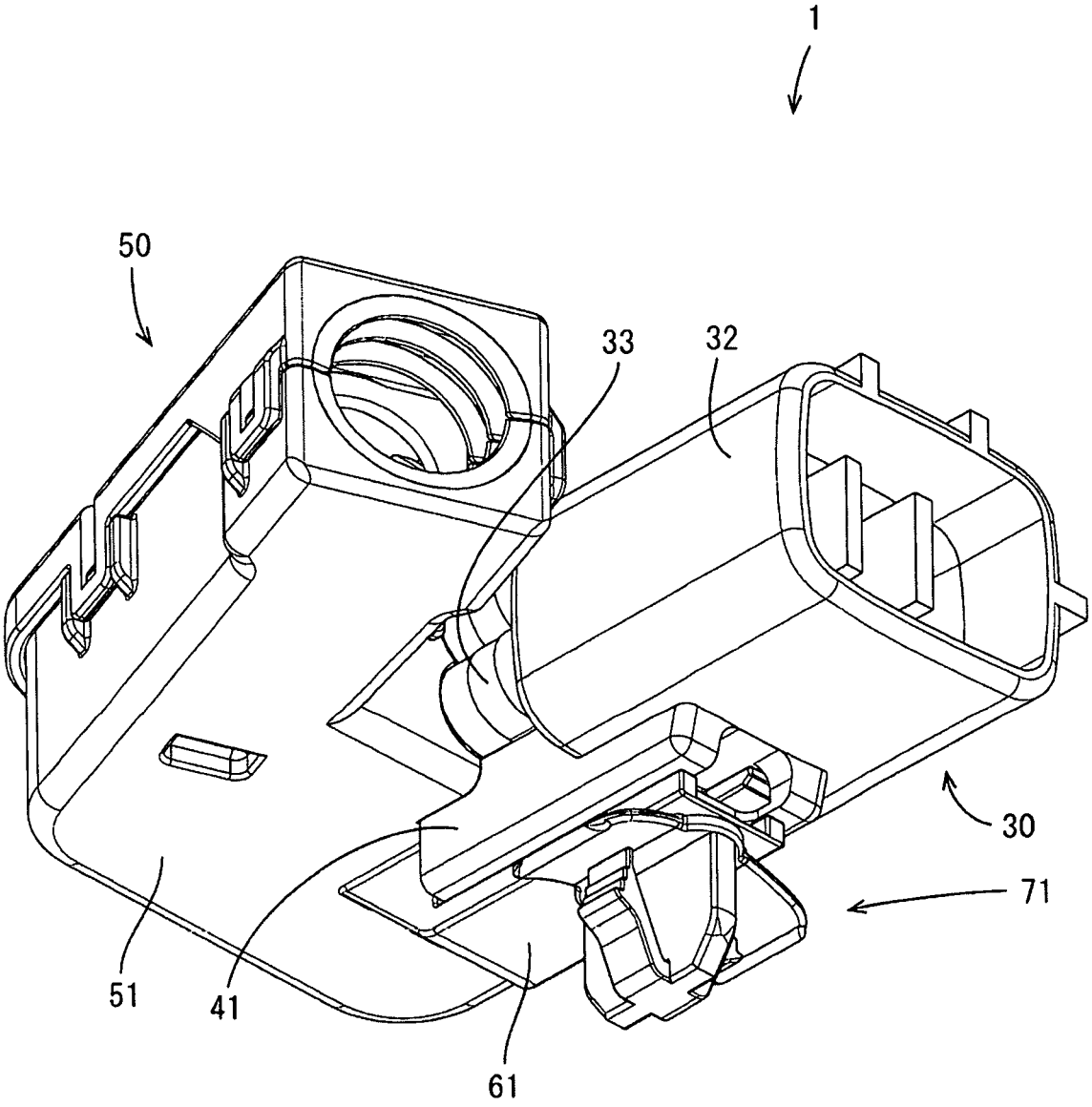
FIG. 1 is a perspective view of a connector with cover of an embodiment.

An embodiment is described with reference to FIGS. 1 to 14. A connector with cover of this embodiment is for an electric brake system of a vehicle and is arranged near a tire by being mounted on a vehicle body panel. This connector with cover 1 includes terminal-equipped wires 10 having wires 11, rubber plugs 20 (equivalent to a sealing member) to be mounted on the wires 11, a connector housing 30 for holding the terminal-equipped wires 10, and a cover 50 to be assembled with the connector housing 30. As shown in FIG. 1, the connector housing 30 includes a cassette 41. Further, the cover 50 includes a cover body 51 for covering the wires 11 drawn out from the connector housing 30, a bracket portion 61 continuous from the cover body 51 and to be assembled with the cassette 41, and a vehicle body mounting portion 71 continuous from the bracket portion 61 and to be assembled with the vehicle body panel.

[Terminal-Equipped Wires 10 and Rubber Plugs 20]

Figure 2:
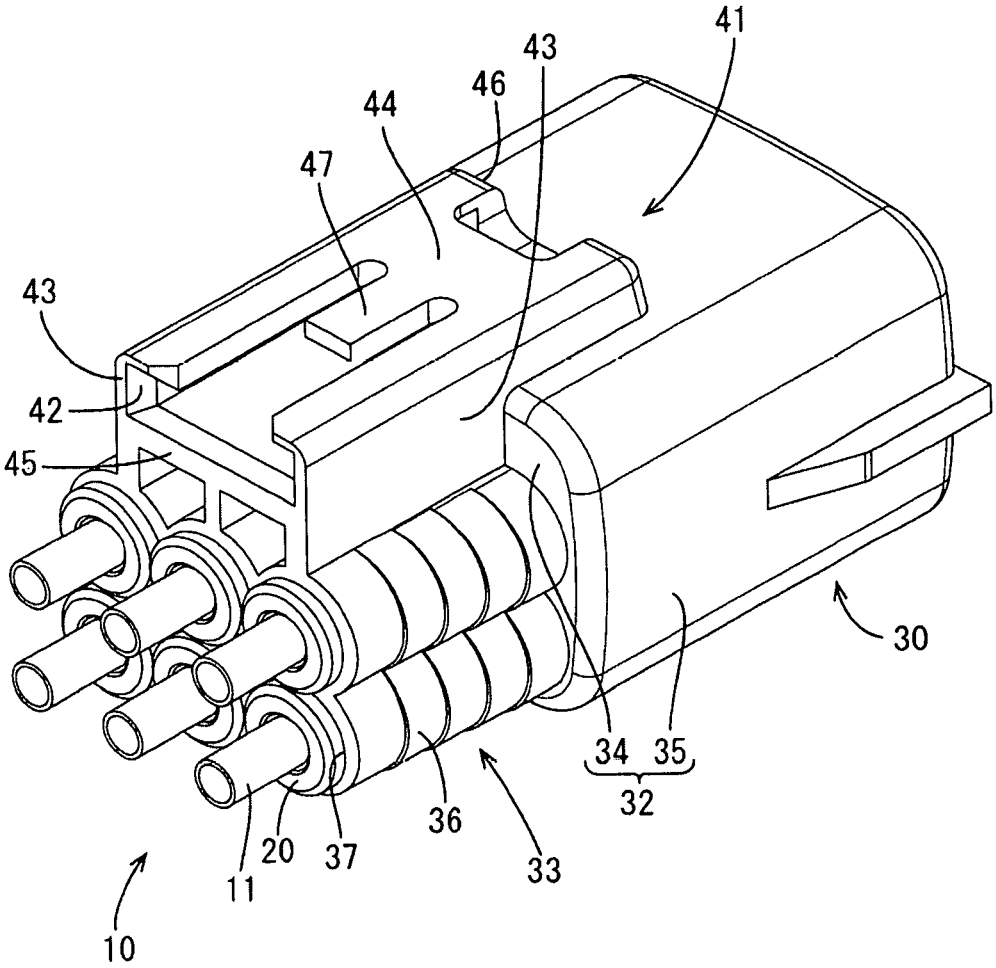
FIG. 2 is a perspective view of a connector housing having terminal-equipped wires and rubber plugs mounted therein in the embodiment.

Each of the terminal-equipped wires 10 includes the wire 11 and a terminal fitting crimped to an end of the wire 11. The terminal fitting is a male terminal fitting including a tab. As shown in FIG. 2, the rubber plugs 20 are mounted respectively on each of the terminal-equipped wires 10. Each rubber plug 20 has a hollow cylindrical shape and the wire 11 is inserted tightly into a center hole of this rubber plug 20. The terminal fitting is crimped to one end part of the rubber plug 20 and the wire 11.

[Connector Housing 30]

Figure 4:
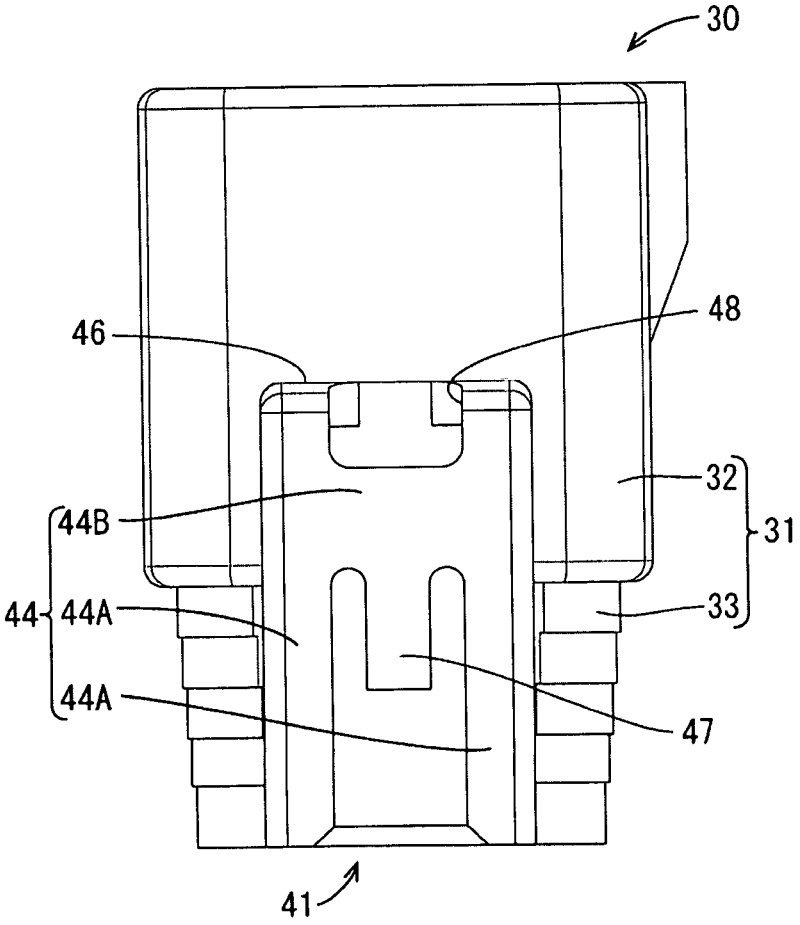
FIG. 4 is a bottom view of the connector housing of the embodiment.

The connector housing 30 is made of synthetic resin and includes, as shown in FIG. 4, a housing body 31 and the cassette 41 continuous from the housing body 31.

As shown in FIGS. 2 and 4, the housing body 31 includes a receptacle 32 to be fit to a mating connector and a wire holding portion 33 continuous from the receptacle 32.

Figure 3:
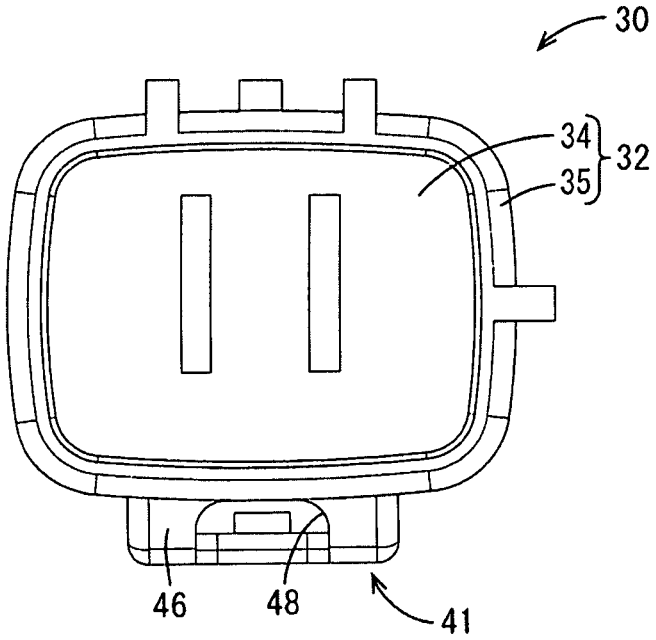
FIG. 3 is a front view of the connector housing of the embodiment.

As shown in FIG. 3, the receptacle 32 includes a bottom wall 34 in the form of a rectangular plate and a peripheral wall 35 in the form of a rectangular tube extending from the peripheral edge of the bottom wall 34. As shown in FIG. 2, the wire holding portion 33 includes hollow cylindrical accommodating tubes 36 that extend from the bottom wall 34. The accommodating tubes 36 are vertically and horizontally arrayed in close contact with each other. An internal space of each accommodating tube 36 serves as a cover 37 that receives an end of the wire 11, a part of the terminal fitting crimped to the end of the wire 11 and most of the rubber plug 20. The rubber plug 20 seals a clearance between the wire 11 and an inner wall of the accommodating tube 36. Note that the structure of the wire holding portion 33 is simplified and the wires 11 and the rubber plugs 20 are not shown in figures other than FIG. 2 in view of the visibility of the figures.

Figure 13:
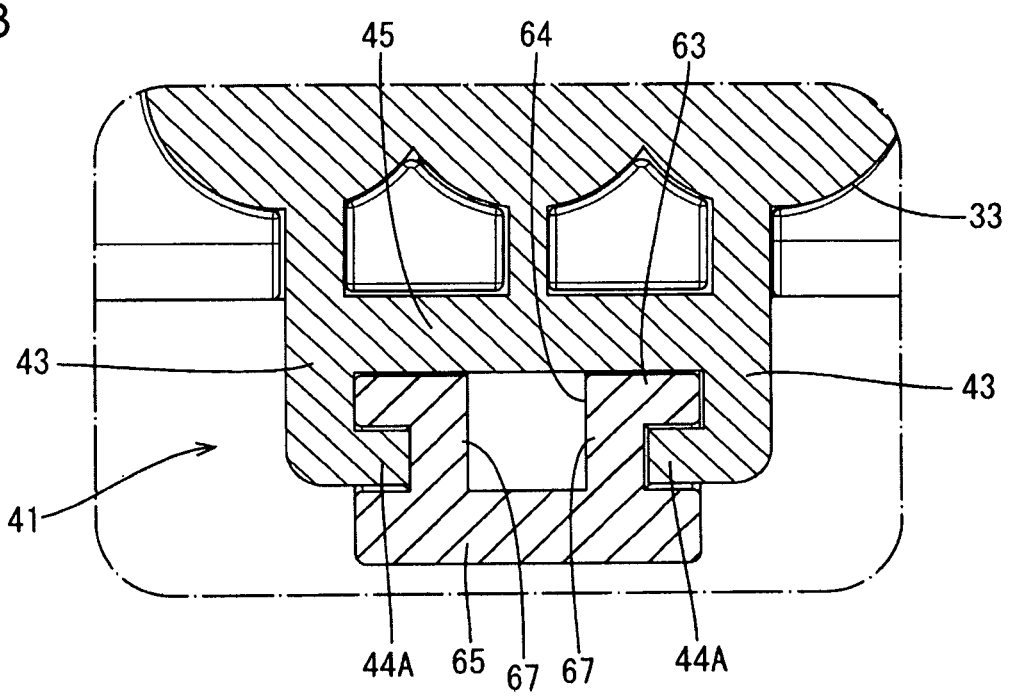
FIG. 13 is a section along A-A of FIG. 12.

As shown in FIG. 2, the cassette 41 is an elongated box-like part continuous with the housing body 31 and includes an insertion slot 42 in one surface on the side of the wire holding portion 33. As shown in FIGS. 2, 4 and 13, the cassette 41 includes two side walls 43 extending from the housing body 31 and arranged parallel to each other, a first supporting wall 44 (equivalent to an outer wall) and a second supporting wall 45 arranged between the two side walls 43, a butting wall 46 arranged on one end of the first supporting wall 44, and an engaging portion 47 extending from the first supporting wall 44.

Figure 14:
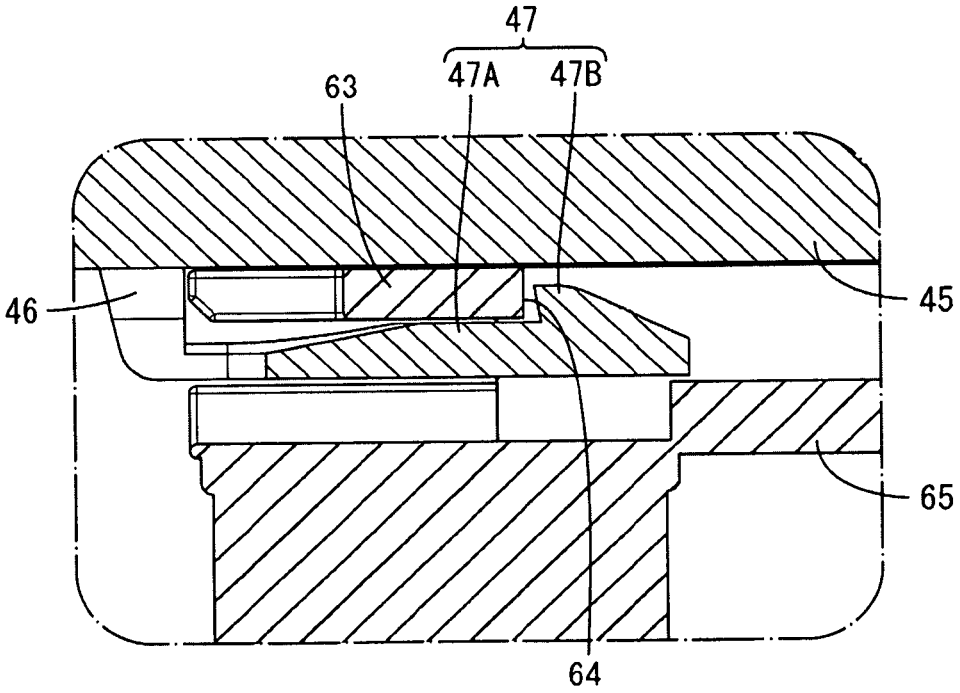
FIG. 14 is a section along B-B of FIG. 12.

As shown in FIG. 2, each of the side walls 43 is elongated and is arranged over the receptacle 32 and the wire holding portion 33. As shown in FIG. 4, the first supporting wall 44 has an H-shape including strip-like longitudinal plates 44A extending along the extending ends of the two side walls 43 and a lateral plate 44B linking the two longitudinal plates 44A. As shown in FIGS. 2 and 3, the second supporting wall 45 extends along the wire holding portion 33 from the bottom wall 34, and is parallel to the first supporting wall 44. As shown in FIGS. 2, 4 and 14, the butting wall 46 links the two longitudinal plates 44A and the peripheral wall 35, and is arranged on a side opposite to the insertion slot 42. The butting wall 46 includes, at a center position between the two side walls 43, a first tool insertion opening 48 into which a tool is inserted for disengaging the bracket 61 and the cassette 41.

As shown in FIG. 14, the engaging portion 47 includes an engaging piece 47A in the form of a plate extending from the lateral plate 44B and an engaging claw 47B extending inward from the tip of the engaging piece 47A. The engaging piece 47A can be deflected in directions toward and away from the housing body 31.

[Cover 50]

Figure 5:
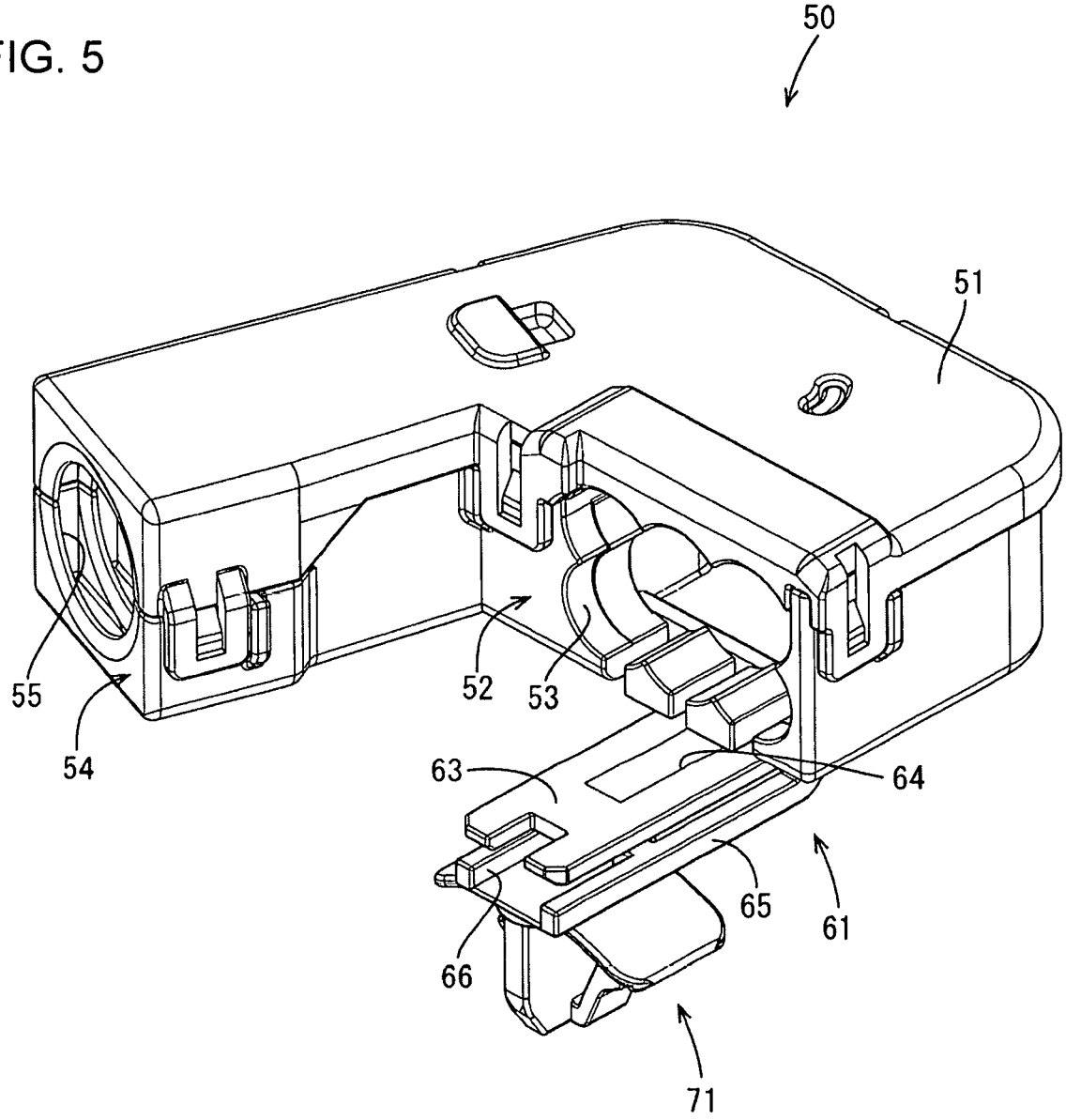
FIG. 5 is a perspective view of a cover of the embodiment.

As shown in FIG. 5, the cover 50 includes the cover body 51, the bracket 61 connected to the cover body 51 and to be assembled with the cassette 41, and the vehicle body mounting portion 71 connected to the bracket 61 and to be mounted on the vehicle body panel.

Figure 6:
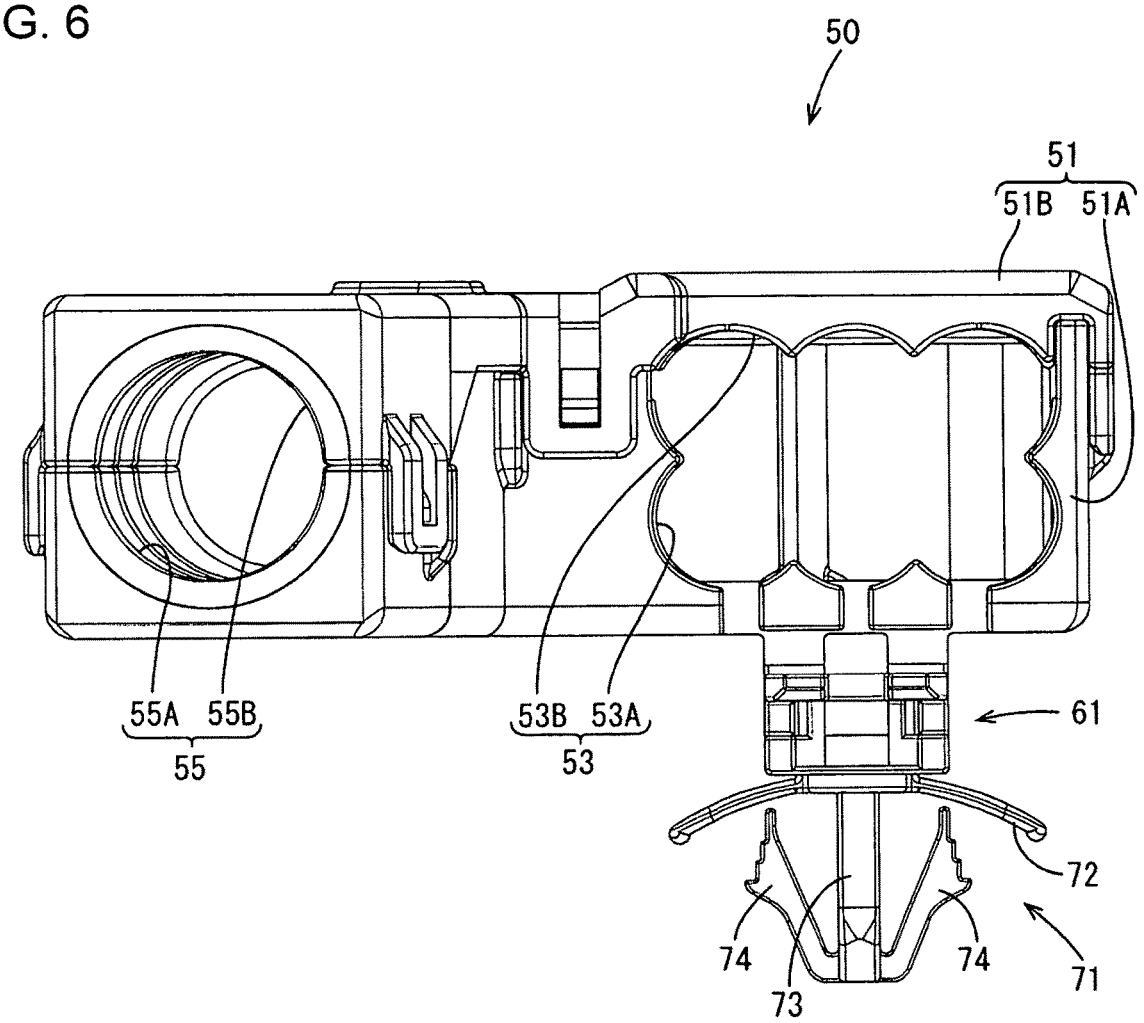
FIG. 6 is a front view of the cover of the embodiment.

As shown in FIG. 5, the cover body 51 is an L-shaped tube. One end of the cover body 51 includes a tubular housing holding portion 53 that is open in an insertion surface 52 and holds the connector housing 30 inside. The other end part has a tubular draw-out portion 55 that is open in a draw-out surface 54 different from the insertion surface 52. A corrugated tube to be fit externally on the wires 11 is held in the draw-out portion 55. As shown in FIG. 6, the cover body 51 is composed of a lower cover 51A and an upper cover 51B that is formed separately from the lower cover 51A but is assembled with the lower cover 51A. The upper cover 51B includes an upper holding portion 53B constituting a part of the housing holding portion 53 and an upper draw-out portion 55B constituting a part of the draw-out portion 55. The lower cover 51A includes a lower holding portion 53A constituting the remaining part of the housing holding portion 53 and a lower draw-out portion 55A constituting the remaining part of the draw-out portion 55.

Figure 7:
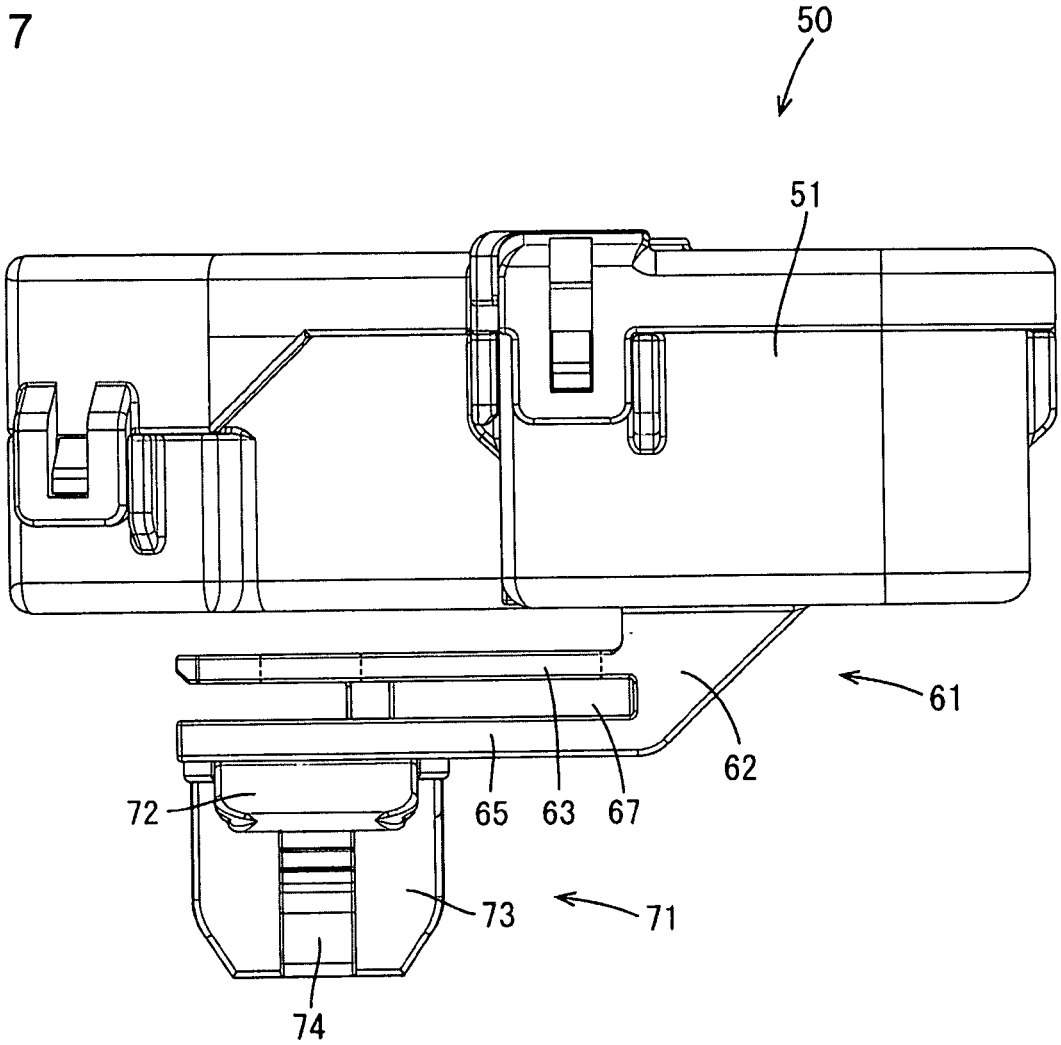
FIG. 7 is a side view of the cover of the embodiment.

As shown in FIGS. 7 and 13, the bracket 61 includes a coupling 62 extending from the lower cover 51A, an insertion piece 63 and an auxiliary piece 65 extending from the coupling 62 and two columns 67 linking the insertion piece 63 and the auxiliary piece 65.

Figure 8:
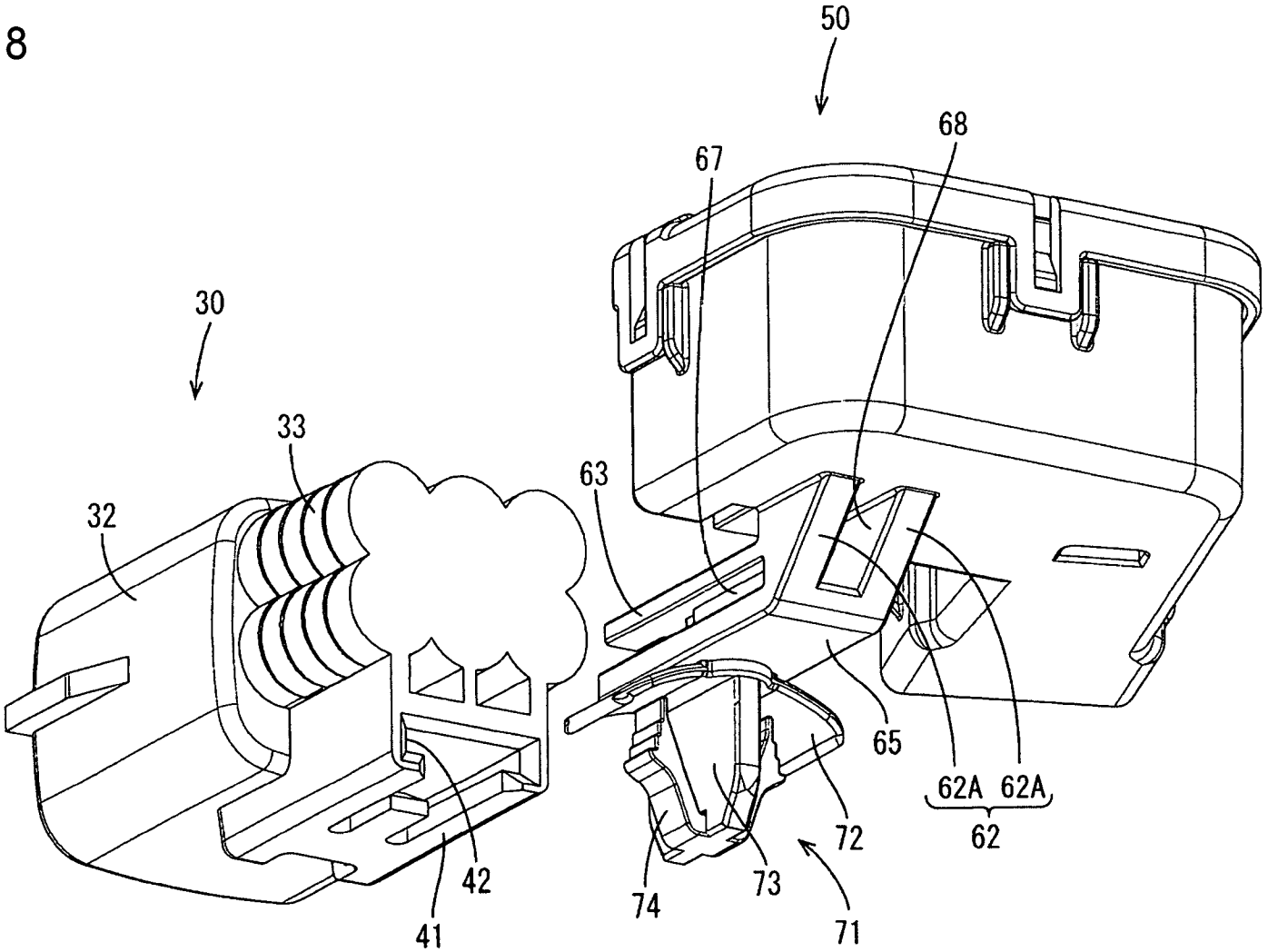
FIG. 8 is an exploded perspective view of the connector with cover of the embodiment.

As shown in FIG. 8, the coupling 62 is composed of two coupling plates 62A arranged at a distance from each other. A clearance between the two coupling plates 62A serves as a second tool insertion opening 68 into which the tool is inserted when disengaging the bracket 61 and the cassette 41. The insertion piece 63 is an elongated plate-like part extending from the coupling 62 and arranged perpendicularly to the insertion surface 52, as shown in FIGS. 5, 7 and 8 and includes an engaging hole 64 capable of receiving the engaging claw 47B, as shown in FIG. 5. The auxiliary piece 65 is an elongated plate-like part extending from the coupling 62 in parallel to the insertion piece 63 while being spaced apart from the insertion piece 63, as shown in FIGS. 5, 7 and 8. As shown in FIG. 5, the auxiliary piece 65 includes a deflection recess 66 recessed from a surface facing the insertion piece 63. Each of the two columns 67 is a plate linking the insertion piece 63 and the auxiliary piece 65 and extends in the same direction as the insertion piece 63 and the auxiliary piece 65 from the coupling 62, as shown in FIGS. 8 and 13. As shown in FIG. 13, the two columns 67 are arranged on both sides of the engaging hole 64.

The vehicle body mounting portion 71 is a part to be fixed to the vehicle body panel and includes, as shown in FIGS. 6 and 8, a flange 72, a base portion 73 extending from the flange 72 and two inclined pieces 74 extending from the base 73. The flange 72 is arched, as shown in FIGS. 6 and 8, and an arched convex surface is connected to a surface (lower surface in FIG. 7) of the auxiliary piece 65 on a side opposite to the insertion piece 63 and the lower holding portion 53A, as shown in FIGS. 7 and 8. As shown in FIG. 6, the base 73 is a plate continuous from the flange 72 and extending in a direction perpendicular to the auxiliary piece 65. As shown in FIG. 6, each of the inclined pieces 74 is a plate extending in a direction toward the flange 72 from the extending end of the base 73. The two inclined pieces 74 are inclined to be more separated from the base 73 toward the flange 72.

[Assembling of Connector with Cover 1 and Mounting on Vehicle Body]

In assembling the connector with cover 1, the terminal-equipped wires 10 having the rubber plugs 20 mounted thereon are first mounted into the connector housing 30. The terminal fittings crimped to the ends of the wires 11 are inserted into the cavities 37. With the terminal fittings held at proper positions, the tabs project into the receptacle 32 through a back wall. Further, the rubber plugs 20 are held in close contact with the outer peripheral surfaces of the wires 11 and the inner walls of the accommodating tubes 36 to seal the clearances between the wires 11 and the accommodating tubes 36. In this way, the mounting of the terminal-equipped wires 10 into the connector housing 30 is completed.

Subsequently, the cover 50 is assembled with the connector housing 30 having the terminal-equipped wires 10 mounted therein.

First, the bracket portion 61 is assembled with the cassette 41 with the upper cover 51B removed from the lower cover 51A. The insertion piece 63 is inserted into the cassette 41 through the insertion slot 42 and enters a clearance between the first and second supporting walls 44 and 45. The insertion piece 63 butts against the engaging claw 47B and pushes the engaging claw 47B so that the engaging piece 47A is deflected away from the connector housing 30. At this time, the engaging piece 47A enters the deflection recess 66, and the deflection of the engaging piece 47A is not obstructed due to interference of the auxiliary piece 65 with the engaging piece 47A. As the insertion piece 63 is inserted farther, the wire holding portion 33 enters the lower holding portion 53A. When the insertion piece 63 is inserted to a position where the tip thereof butts against the butting wall 46. At this point, the engaging claw 47B enters the engaging hole 64 and engages an edge of the engaging hole 64 to retain the insertion piece 63. In this way, the assembling of the bracket 61 with the cassette 41 is completed (see FIG. 11).

Figure 11:
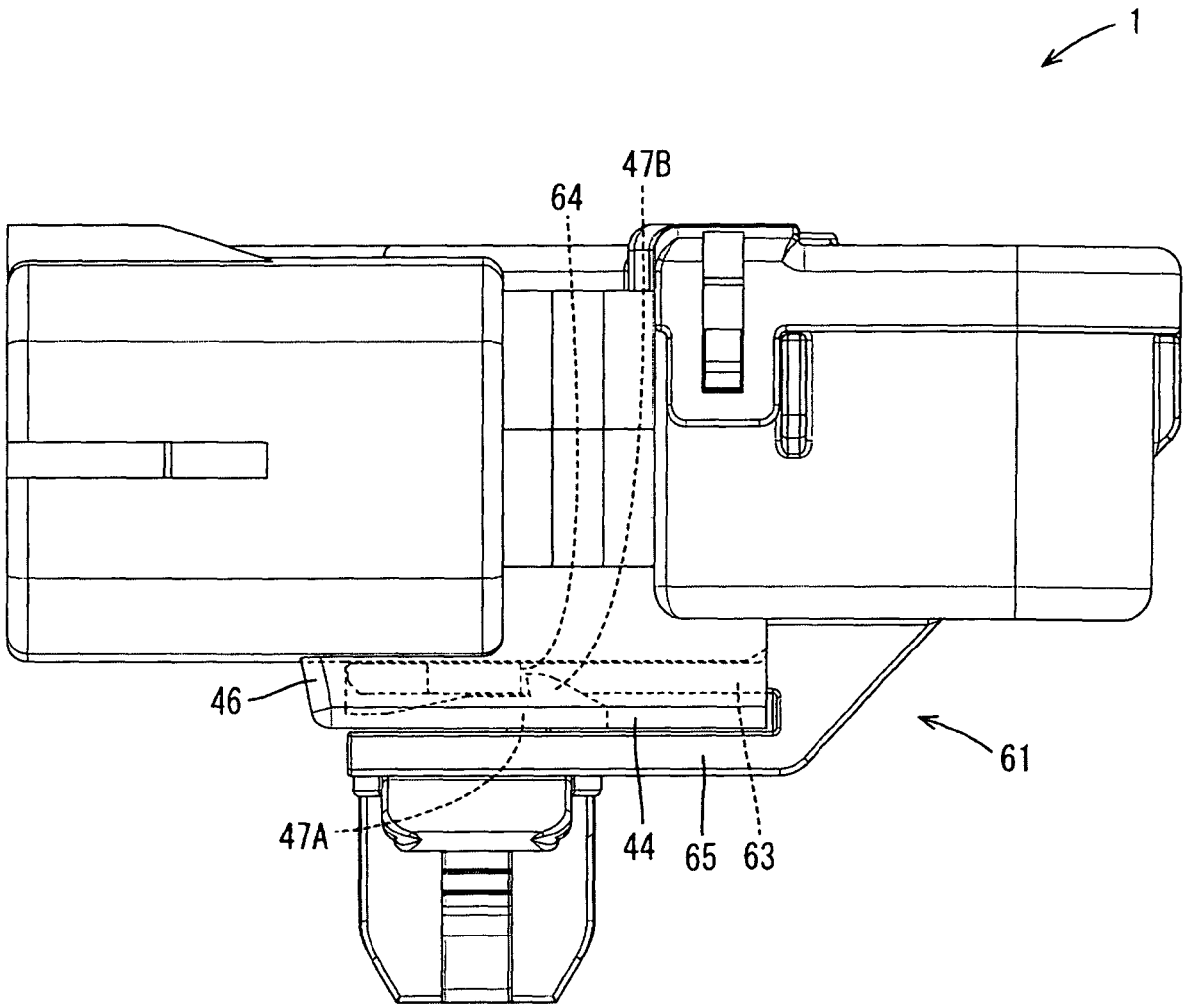
FIG. 11 is a side view of the connector with cover of the embodiment.
Figure 12:
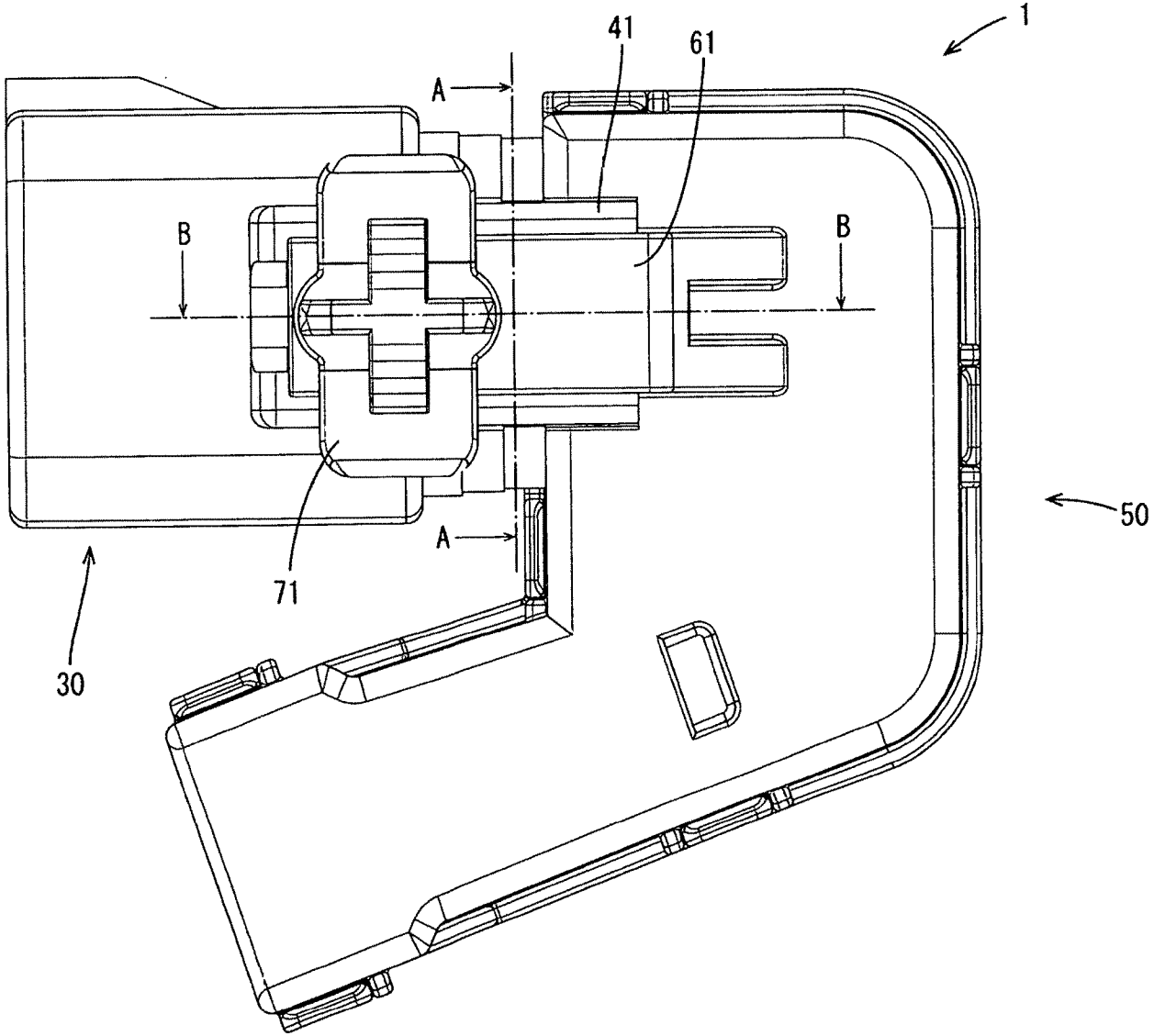
FIG. 12 is a bottom view of the connector with cover of the embodiment.

Assembly of the bracket 61 with the cassette 41 causes the insertion piece 63 to be accommodated in a clearance defined by the second supporting wall 45, the peripheral wall 35 and the first supporting wall 44, as shown in FIGS. 11 and 13. The first supporting wall 44 is arranged along the insertion piece 63, and the auxiliary piece 65 is arranged along the first supporting wall 44 outside the cassette 41. As just described, the auxiliary piece 65 is arranged to cover the first supporting wall 44 from outside to sandwich the first supporting wall 44 between the insertion piece 63 and the auxiliary piece 65. In this way, the bracket 61 is less likely to disengage from the cassette 41 even when a water pressure of high pressure washing acts on an engaged part of the cassette 41 and the bracket 61 as compared to the case where the bracket 61 does not include the auxiliary piece 65. Further, since the engaging piece 47A extending from the first supporting wall 44 also is covered from outside by the auxiliary piece 65, as shown in FIG. 11, the deflection of the engaging piece 47A in a direction to disengage from the insertion piece 63 in an unintended situation is avoided.

The two columns 67 enter between the two longitudinal plates 44A, as shown in FIG. 13. The columns 67 are arranged across the engaging hole 64. Thus, the engaging piece 47A engaged with the hole edge of the engaging hole 64 is located between the two columns 67. Since the engaging piece 47A is surrounded by the columns 67 in this way, the deflection of the engaging piece 47A in the direction to disengage from the insertion piece 63 in an unintended situation is avoided. Note that the two columns 67 are closer to the coupling 62 than to the lateral plate 44B and do not interfere with the lateral plate 44B.

When the assembling of the bracket 61 with the cassette 41 is completed, most of the wire holding portion 33 is fit inside the lower holding portion 53A. In this state, the wires 11 drawn out from the wire holding portion 33 are passed through the lower cover 51A and drawn out to the outside from the lower draw-out portion 55A.

Figure 9:
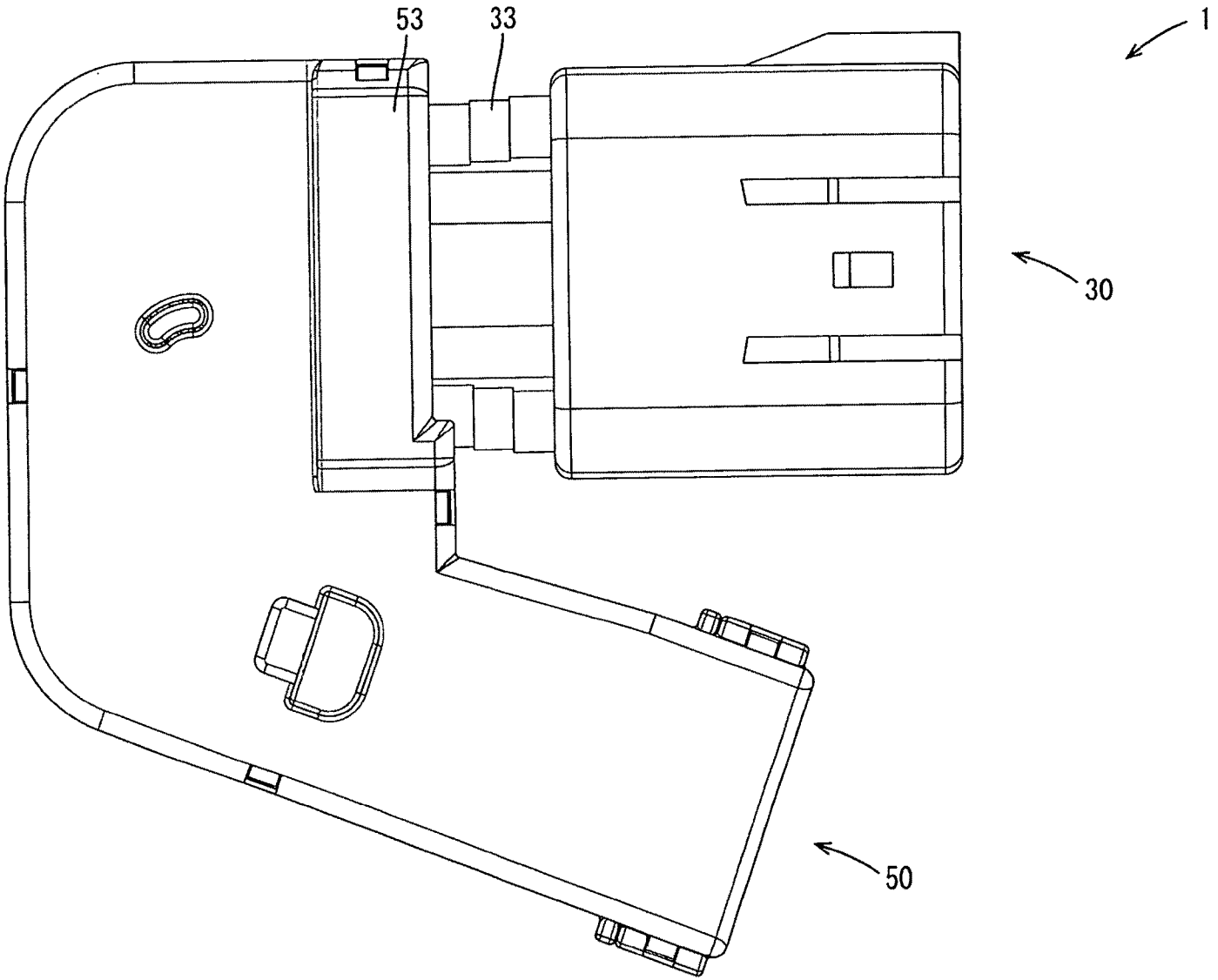
FIG. 9 is a plan view of the connector with cover of the embodiment.
Figure 10:
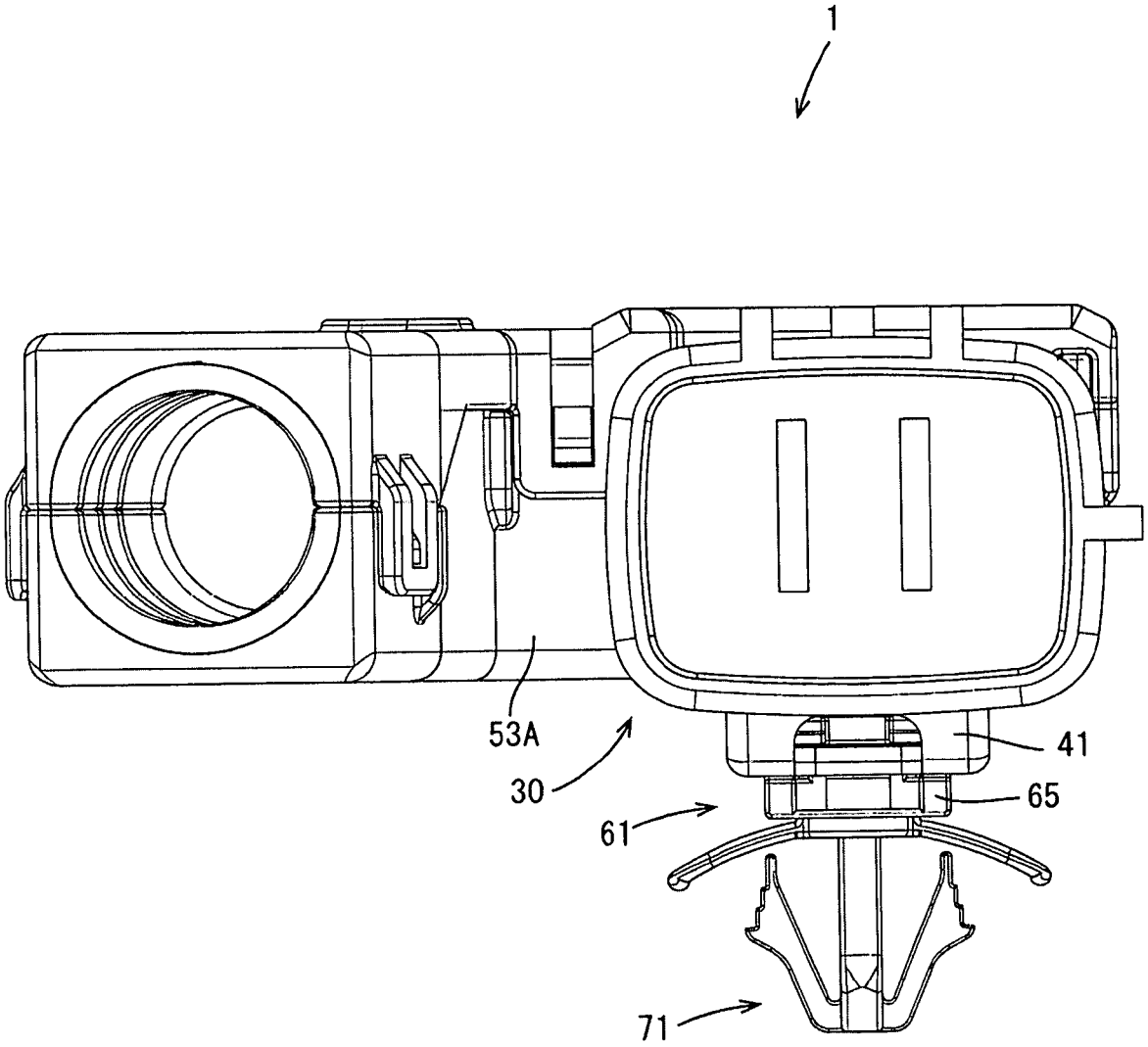
FIG. 10 is a front view of the connector with cover of the embodiment.

Subsequently, the upper cover 51B is assembled with the lower cover 51A into the tubular cover body 51 to complete the assembling of the connector with cover 1. Thus, most of the wire holding portion 33 is accommodated inside the housing holding portion 53 and the wires 11 drawn out from this wire holding portion 33 are covered by the cover 50, as shown in FIGS. 9 and 11. Specifically, the cover 50 covers a part where clearances between the wire holding portion 33 and the wires 11 are sealed by the rubber plugs 20. The other end parts of the wires 11 are passed through the cover body 51 and drawn out to the outside. Further, the vehicle body mounting portion 71 extends from a surface of the auxiliary piece 65 on a side opposite to the lower holding portion 53A, as shown in FIG. 10. Specifically, the vehicle body mounting portion 71 extends toward a side opposite to the connector housing 30 with respect to the bracket 61.

After the assembling of the connector with cover 1 is completed, the connector with cover 1 is mounted on the vehicle body panel. The vehicle body panel includes a mounting hole and the base 73 and the two inclined pieces 74 are pushed into this mounting hole. The inclined pieces 74 are pushed by an opening edge of the mounting hole and deflect inward. The vehicle body mounting portion 71 is pushed until the flange 72 contacts the vehicle body panel. The two inclined pieces 74 are passed through the mounting hole and restored. Thus, the vehicle body panel is sandwiched between the flange 72 and the two inclined pieces 74 to complete the mounting of the connector with cover 1 on the vehicle body panel.

In removing the connector housing 30 from the cover 50 for maintenance or the like, the tool is inserted through the first and second tool insertion openings 48, 68. Then, the engaging piece 47A is deflected by the tool to disengage the engaging claw 47B from the edge of the engaging hole 64, and the insertion piece 63 is pulled out from the cassette 41.

[Functions and Effects]

As described above, the connector with cover 1 is to be mounted on the vehicle body panel and has the wires 11, the connector housing 30 including the housing body 31 having the wire holding portion 33 for accommodating the ends of the wires 11 and the cassette 41 continuous from the housing body 31 and having the insertion slot 42 in one surface. The rubber plugs 20 for sealing the clearances between the wire holding portion 33 and the wires 11 are mounted on the wires 11, and the cover 50 is assembled with the connector housing 30 for covering the wire holding portion 33 and the wires 11. The cover 50 has the bracket 61 including the insertion piece 63 to be inserted into the cassette 41 through the insertion slot 42. The bracket 61 is assembled with the cassette 41, and the vehicle body mounting portion 71 connected to the bracket portion 61 and to be mounted on the vehicle body panel.

According to the above configuration, the cover 50 covers the wire holding portion 33 and the wires 11 drawn out from the wire holding portion 33. Specifically, clearances between the wire holding portion 33 and the wires 11 are sealed by the rubber plugs 20 that are covered by the cover 50 to avoid a direct hit of water on the sealed part. Thus, water intrusion into the connector housing 30 from the sealed part is avoided even when a water pressure higher than usual acts, such as when the vehicle is washed under high pressure.

Further, the cover 50 has the bracket 61 to be assembled with the cassette 41 and the vehicle body mounting portion 71 to be mounted on the vehicle body. This enables the cassette 41 conventionally provided to mount the connector housing 30 on the vehicle body to be used for mounting on the cover 50. Thus, the cover 50 can be mounted on the connector housing 30 and waterproof performance can be improved without a large design change.

Furthermore, the vehicle body mounting portion 71 is continuous with the bracket 61. According to this configuration, an assembled part of the connector housing 30 and the cover 50 and an assembled part of the cover 50 and the vehicle body panel can support each other and mounting strength is ensured when a high pressure water acts as compared to the case where the vehicle body mounting portion 71 and the bracket 61 are at distant positions.

Further, the cassette 41 is provided with the first supporting wall 44 arranged along the insertion piece 63 and the bracket 61 is provided with auxiliary piece 65 arranged to sandwich the first supporting wall 44 between the insertion piece 63 and the auxiliary piece 65. According to this configuration, the auxiliary piece 65 is arranged to sandwich the first supporting wall 44 between the insertion piece 63 and the auxiliary piece 65. Thus, the cover 50 is less likely to be detached from the housing 30 and mounting strength is improved even when a water pressure higher than usual acts on the connector with cover 1.

Further, the vehicle body mounting portion 71 extends toward the side opposite to the connector housing 30 with respect to the bracket 61. According to this configuration, since the connector housing 30, the assembled part of the connector housing 30 and the cover 50 and the assembled part of the cover 50 and the vehicle body panel are arranged in a row, the assembled part of the connector housing 30 and the cover 50 and the assembled part of the cover 50 and the vehicle body panel can support each other to increase a hold-on force and mounting strength is ensured when a water pressure higher than usual acts.

Other Embodiments

The shape of a vehicle body holding portion is not limited to that of the above embodiment. For example, the vehicle body holding portion may be a second bracket portion to be screwed to the vehicle body panel.

The bracket may not include the auxiliary piece. In that case, the vehicle body mounting portion may extend from the insertion piece.

The vehicle body mounting portion may be a member separate from the cover body and the bracket and may be assembled with the bracket. In that case, the vehicle body mounting portion on which a largest stress is likely to act when an external force is applied may be formed of a material high in strength, and the cover body and the bracket portion may be formed of an inexpensive material. Polyamide 6T is illustrated as the material of the vehicle body mounting portion and polypropylene is illustrated as the material of the cover body and the bracket portion.

LIST OF REFERENCE SIGNS

1: connector with cover
10: terminal-equipped wire
11: wire
20: rubber plug (sealing member)
30: connector housing
31: housing body
32: receptacle
33: wire holding portion
34: bottom wall portion
35: peripheral wall portion
36: accommodating tube portion
37: cavity
41: cassette
42: insertion slot
43: side wall
44: first supporting wall (outer wall)
44A: longitudinal plate portion
44B: lateral plate
45: second supporting wall
46: butting wall
47: engaging portion
47A: engaging piece
47B: engaging claw
48: first tool insertion opening
50: cover
51: cover body
51A: lower cover portion
51B: upper cover
52: insertion surface
53: housing holding portion
53A: lower holding portion
53B: upper holding portion
54: draw-out surface
55: draw-out portion
55A: lower draw-out portion
55B: upper draw-out portion
61: bracket
62: coupling
62A: coupling plate
63: insertion piece
64: engaging hole
65: auxiliary piece
66: deflection recess
67: column portion
68: second tool insertion opening
71: vehicle body mounting portion
72: flange portion
73: base portion
74: inclined piece

What is claimed is:

1. A connector with cover to be mounted on a vehicle body of a vehicle, comprising:

a wire;

a connector housing including a housing body having a wire holding portion extending in an extending direction for holding an end of the wire and a cassette continuous from the housing body and having an insertion slot in one surface extending in the extending direction;

a sealing member for sealing a clearance between the wire holding portion and the wire by being mounted on the wire; and a cover for covering the wire holding portion and the wire by being assembled with the connector housing, the cover including a bracket having a coupling coupled directly to an outer surface of the cover and an insertion piece extending from the coupling to be inserted into the cassette through the insertion slot, the bracket being assembled with the cassette, and a vehicle body mounting portion connected to the bracket and to be mounted on the vehicle body.

2. The connector with cover of claim 1, wherein:

the cassette includes an outer wall arranged along the insertion piece; and the bracket includes an auxiliary piece arranged to sandwich the outer wall between the insertion piece and the auxiliary piece.

3. The connector with cover of claim 2, wherein the vehicle body mounting portion extends toward a side opposite to the connector housing with respect to the bracket.

4. The connector with cover of claim 1, wherein the vehicle body mounting portion extends toward a side opposite to the connector housing with respect to the bracket.

* * * * *